US006431615B1

(12) United States Patent
Bastian

(10) Patent No.: US 6,431,615 B1
(45) Date of Patent: Aug. 13, 2002

(54) LATCHING ASSEMBLY

(75) Inventor: John M. Bastian, Manitowoc, WI (US)

(73) Assignee: Fisher Hamilton L.L.C., Two Rivers, WI (US)

( * ) Notice: Subject to any disclaimer, the term of this patent is extended or adjusted under 35 U.S.C. 154(b) by 0 days.

(21) Appl. No.: 09/561,242

(22) Filed: Apr. 28, 2000

(51) Int. Cl.[7] ..... E05C 19/06

(52) U.S. Cl. ..... 292/80; 292/24; 292/121; 292/DIG. 30; 312/222; 312/332.1

(58) Field of Search ..... 292/80, DIG. 30, 292/31, 121, 128, 24; 312/332.1, 333, 222, 216, 217, 218, 220

(56) References Cited

U.S. PATENT DOCUMENTS 3,031,248 A * 4/1962 Jeeves ..... 312/320
3,122,402 A * 2/1964 Bullock et al. ..... 312/320
3,239,298 A * 3/1966 McCarthy ..... 312/243.2
3,294,463 A * 12/1966 Kafferlin et al. ..... 312/234.5
3,450,453 A * 6/1969 Tazaki ..... 312/222
3,549,228 A * 12/1970 Aleks ..... 312/320
3,574,436 A * 4/1971 Anderson ..... 312/320
3,842,758 A 10/1974 Armstrong et al.
3,862,506 A 1/1975 Drenten et al.
4,460,222 A * 7/1984 Larking ..... 312/286
5,292,191 A * 3/1994 Slivon ..... 312/332.1
D349,838 S 8/1994 Barton et al.
5,413,409 A * 5/1995 Arai ..... 312/330.1
5,775,140 A * 7/1998 Hallsten ..... 70/85
D402,528 S 12/1998 Brucker

* cited by examiner

*Primary Examiner*—Paul N. Dickson
*Assistant Examiner*—Benjamin A Pezzlo
(74) *Attorney, Agent, or Firm*—Rader, Fishman & Grauer PLLC

(57) ABSTRACT

A latching assembly includes a latch mounted to a moveable member, the latch being moveable between a first position where it engages a stop of a base member to releasably secure the moveable member to the base member and a second releasing position. An actuator drives the latch between the first and second positions; and at least one spring biases the latch towards the first position.

20 Claims, 2 Drawing Sheets

LATCHING ASSEMBLY

BACKGROUND OF THE INVENTION

1. Field of the Invention

The present invention relates to a latching assembly and more particularly to a latching assembly for releasably securing a moveable member to a base member. Although the present invention finds particular utility in applications where it releasably secures a drawer to the housing of a cabinet, it may provide the same or similar function in a wide variety of other applications.

2. Description of the Prior Art

A latching assembly or mechanism that releasably secures a moveable member such as a drawer of a cabinet to a base member (e.g., the cabinet housing) should have a number of desirable features. First, it should positively engage the base member to securely and reliably lock the moveable member to the base member. Second, it should allow cooperation with the pull or handle of the moveable member to allow easy operation. Third, it should allow mounting to the moveable member in an unobtrusive manner. Finally, it should have a simple construction that minimizes the expense of fabrication and assembly and the risk of breakdown.

The latching assembly of the present invention has all of the features or advantages outlined above. It has a construction that provides a positive latching action to securely and reliably fasten a moveable member to a base member. It has a simple construction which does indeed minimize the expense of fabrication while providing easy performance; and it mounts onto the moveable member in a clean and unobtrusive manner.

SUMMARY OF THE INVENTION

In accordance with the present invention, a latching assembly for releasably securing a moveable member to a base member includes latching means mounted to the moveable member. One may move the latching means between a first, latching position in which the latching means engages a stop portion of the base member and a second, releasing position. An actuator mounted to the moveable member engages the latching means and allows an operator to drive the latching means between the first and second positions. At least one spring biases the latching means towards the first position. In one embodiment, the latching means includes a plate with a flange portion. In another embodiment the latching means includes a pivoting segment that the actuator engages, an engaging segment that engages the stop portion and a linkage segment that connects the pivoting segment with the engaging segment.

BRIEF DESCRIPTION OF THE DRAWINGS

For a more complete understanding of this invention, one should now refer to the embodiments illustrated in greater detail in the accompanying drawings and described below by way of an example of the invention. In the drawings.

While the following disclosure describes the invention in connection with two embodiments, one should understand that the invention is not limited to these embodiments. Furthermore, one should understand that the drawings are not to scale and that graphic symbols, diagrammatic representatives, and fragmentary views, in part, may illustrate the embodiments. In certain instances, the disclosure may not include details which are not necessary for an understanding of the present invention such as conventional details of fabrication and assembly.

DETAILED DESCRIPTION OF THE DRAWINGS

Figure 1:
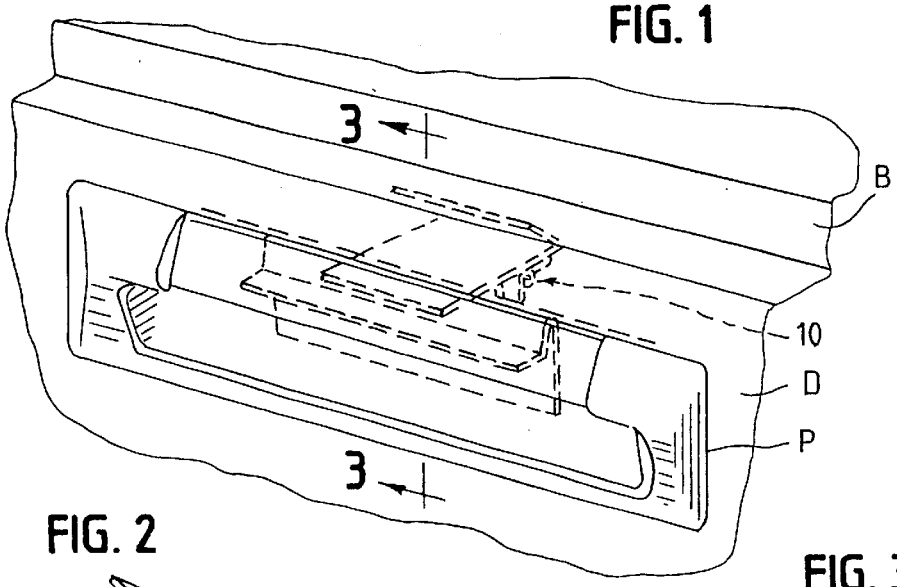
FIG. 1 is a perspective view of a pull for a drawer of a cabinet, incorporating the latching assembly of the present invention and showing it in hidden lines.
Figure 2:
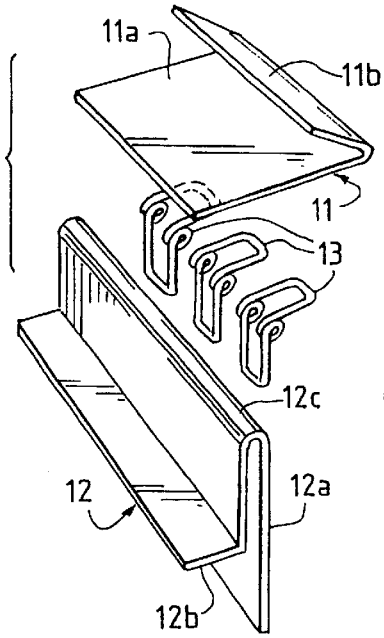
FIG. 2 is an exploded view of the latching assembly of FIG. 1.

Turning now to the drawings and referring specifically to FIGS. 1 and 2, the latching assembly of the present invention shown at 10 lies behind a pull P mounted to the front and top of a drawer D disposed in a cabinet housing B. (One may use the pull P to move the drawer D in and out of the cabinet housing B and the latching assembly 10 to releasably secure the drawer D to the housing B.) The latching assembly 10 generally includes a latch 11, an actuator 12 and a plurality of hinged torsion springs 13.

The latch 11 is a plate made out of sheet metal or any other suitable material of high strength and rigidity; and it includes a main portion 11*a* and a flange portion 11*b*. The flange portion 11*b* extends outwardly of the main portion 11*a* at an acute angle to the main portion 11*a*. This flange portion 11*b* engages a stop portion $B_1$ of the cabinet housing B to releasably secure the drawer D to the cabinet housing B when the latch 11 lies in a first position (shown in solid lines in FIG. 3). The latch 11 extends out of an opening $D_1$ formed in the back side of a shell $D_2$ that forms a hollow front panel of the drawer D. The flange end lies outwardly of the shell $D_2$ while an opposite end (the end that the actuator 12 engages) lies within the shell $D_2$.

Figure 3:
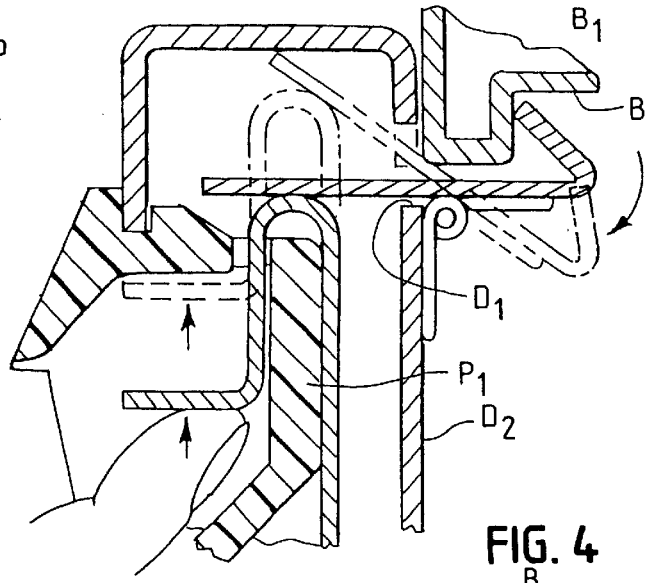
FIG. 3 is a sectional view taken along line 3—3 in FIG. 1 and showing the latch of the latching assembly in solid lines in a first, securing position and in a second, releasing position in phantom lines.

The torsion springs 13 hingedly connect the latch 11 (in teeter-totter fashion) to the drawer D; and they bias the latch to the first position shown in solid lines in FIG. 3. One end of each spring 13 lies fixedly secured (e.g., welded) to the shell $D_2$ proximate the opening $D_1$ while the other end lies fixedly secured (e.g., welded) to the latch 11. Alternatively, the latching assembly may include less than the three springs shown in FIG. 2 or more than three. In addition, a separate hinge and one or more separate springs may replace the torsion springs 13.

Figure 4:
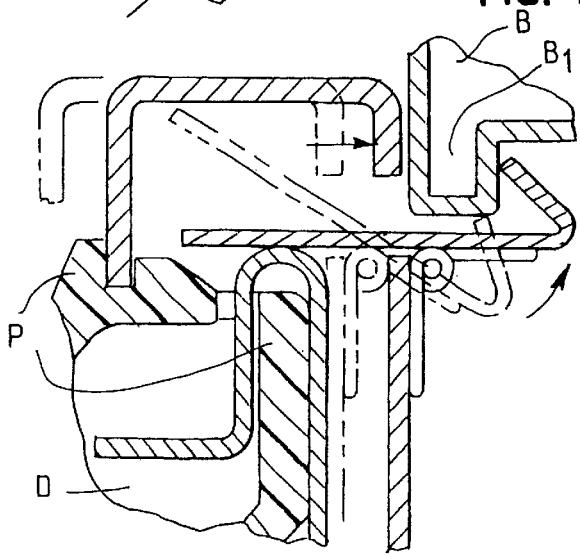
FIG. 4 is the sectional view of FIG. 3 with phantom lines showing the latch disengaged and displaced from the first position.
Figure 5:
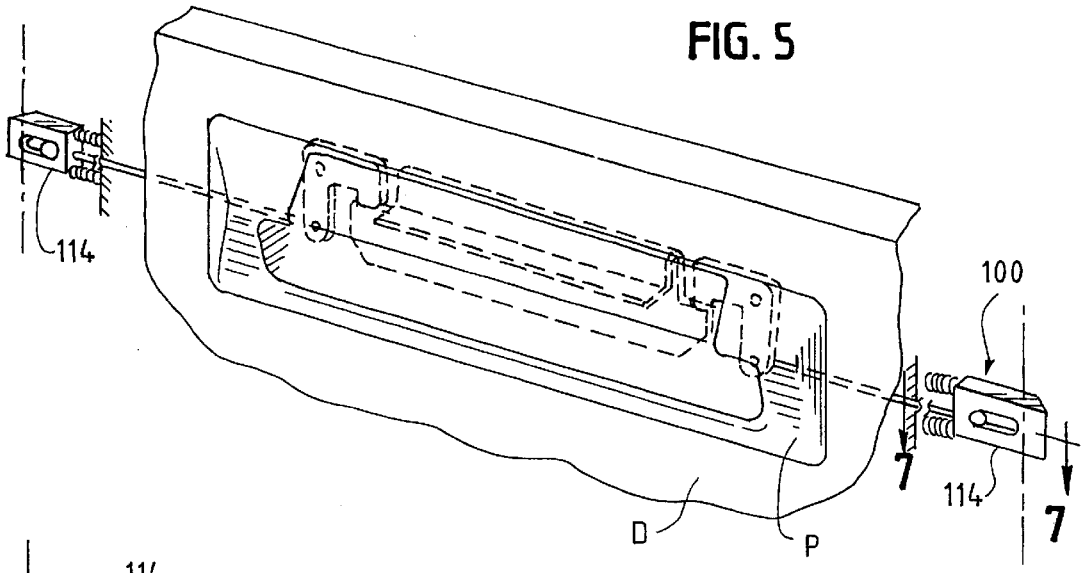
FIG. 5 is a perspective view of the drawer pull of FIG. 1, incorporating another embodiment of the latching assembly of the present invention and showing the assembly partly with hidden lines and partly with solid lines.

The actuator 12, like the latch 11, is made of sheet metal or any other suitable material of suitable strength and rigidity. It includes a channel portion 12*a* having the cross-sectional configuration of an inverted U and a flange portion 12*b*. The channel portion 12*a* receives a wall portion $P_1$ of the pull P; and the flange portion 12*b* receives the finger tips of one who may drive the actuator 12 from the lowered position shown in solid lines in FIG. 3 to the position shown in phantom lines in that figure. As the actuator slides over the wall portion $P_1$, a rounded end 12*c* of the channel portion 12*a* engages the inner end of the latch 11 and drives it from the first, latching position shown in solid lines in FIG. 3 to a second releasing position shown in phantom lines. (In this second position, as shown in phantom lines in FIG. 3, the latch 11 allows the drawer D to move outwardly of the housing B as shown in FIG. 4.)

Figure 6:
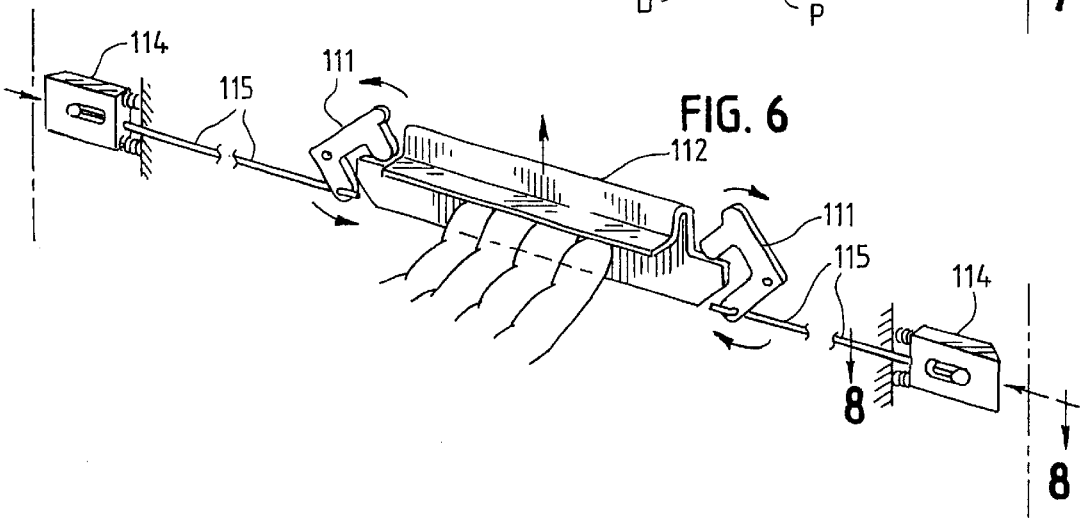
FIG. 6 is a perspective view of the latching assembly of FIG. 5.
Figure 7:
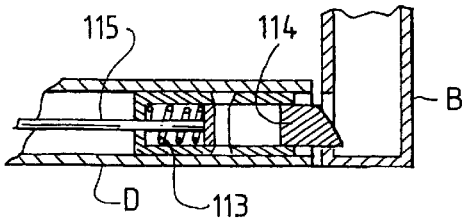
FIG. 7 is a sectional view taken along line 7—7 in FIG. 5.
Figure 8:
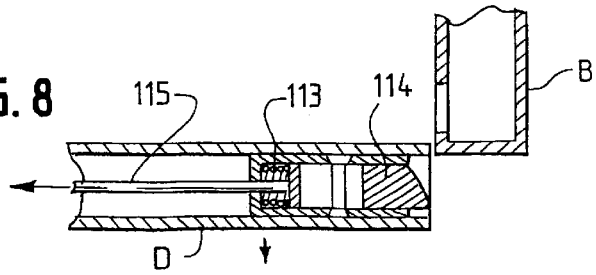
FIG. 8 is a sectional view taken along line 8—8 in FIG. 6.

FIGS. 5–8 show a second embodiment 100 of the latching assembly of the present invention. In this embodiment, the assembly 100 engages the cabinet housing B at the sides of the drawer D rather than at the top. This assembly 100 includes an actuator 112 which drives a pair of pivoting segments 111 that lie pivotally mounted to the drawer D. Each of these segments drives an engaging or latching segment 114 though a linkage arm segment 115 that lies hingedly secured to the pivoting segment 111 at one end and secured to the engaging segment 114 at an opposite end. Compression springs 113 bias the engaging segment 114 outwardly of the drawer and into a first, latching position shown in FIG. 7 where the engaging segment 114 extends into an opening in the cabinet housing B. (The sides of this opening act as a stop.) Raising of the actuator 112 as shown in FIG. 6 pulls the linkage segments 115 inward of the drawer D; and a predetermined force overrides the force of the compression springs 113 and retracts the engaging segments 114 into a second, releasing position (See FIG. 8), thus allowing the drawer D to release from the cabinet housing B.

While the above description and the drawings disclose and illustrate two embodiments, one should understand, of course, that the invention is not limited to these embodiments. Those skilled in the art to which the invention pertains may make other modifications and other embodiments employing the principles of this invention, particularly upon considering the foregoing teachings. Therefore, by the appended claims, the applicant intends to cover any modifications and other embodiments as incorporate those features which constitute the essential features of this invention.

What is claimed is:

1. A latching assembly for releasably securing a moveable member to a base member, the latching assembly comprising:

a moveable actuator mounted on the moveable member;

a moveable latch mounted on the moveable member; and at least one spring for hingedly connecting the moveable member to the movable latch, the at least one spring biasing the latch toward a first, latching position in which the latch engages a stop portion of the base member, wherein a portion of the actuator engages the latch and causes the latch to pivot from the first, latching position to a second, releasing position, thereby allowing the moveable member to move outwardly from the base member.

2. The latching assembly of claim 1, wherein the actuator is slidably mounted on the moveable member.

3. The latching assembly of claim 1, wherein the at least one spring is a torsion spring.

4. The latching assembly of claim 3, further comprising a plurality of springs.

5. The latching assembly of claim 1, wherein the latch lies pivotably mounted to the moveable member proximate the actuator.

6. The latching assembly of claim 5, wherein the latch includes a plate with a flange portion, the flange portion engaging the stop of the base member. engages the stop portion of the base member, a second linkage segment that connects the pivoting segment with the engaging segment and a second spring.

7. The latching assembly of claim 1, wherein the base member is a cabinet housing and the moveable member is a drawer of the cabinet.

8. The latching assembly of claim 1, wherein the moveable member includes a handle portion for grasping the moveable member and driving it from a closed to an open position and back to a closed position.

9. A latching assembly for releasably securing a moveable member to a base member, the latching assembly comprising:

an actuator mounted in sliding relation with the moveable member;

a latch pivotally mounted to the moveable member proximate the actuator; and at least one spring for hingedly connecting the moveable member to the latch, the at least one spring biasing the latch toward a first, latching position in which the latch engages a stop portion of the base member, wherein a portion of the actuator engages the latch and causes the latch to pivot from the first, latching position to a second, releasing position, thereby allowing the moveable member to move outwardly from the base member.

10. The latching assembly of claim 9, wherein the spring is a torsion spring.

11. The latching assembly of claim 10, further comprising a plurality of springs.

12. The latching assembly of claim 9, wherein the latch includes a plate with a flange portion, the flange portion engaging the stop of the base member.

13. The latching assembly of claim 9, wherein the base member is a cabinet housing and the moveable member is a drawer of the cabinet.

14. The latching assembly of claim 9, wherein the moveable member includes a handle portion for grasping the moveable member and driving it from a closed to an open position and back to a closed position.

15. A latching assembly for releasably securing a moveable member to a base member, the latching assembly comprising:

latching means for releasably engaging a stop portion of the base member, said latching means being mounted to the moveable member and moveable between a first, latching position and a second, releasing position;

actuator means mounted on the moveable member for driving the latching means between the first and second positions; and spring means for biasing the latching means towards a first, latching position, said spring means hingedly connecting the moveable member to the latching means, wherein a portion of the actuator means engages the latching means and causes the latching means to pivot from the first, latching position to a second, releasing position, thereby allowing the moveable member to move outwardly from the base member.

16. The latching assembly of claim 15, wherein the spring means is a torsion spring.

17. The latching assembly of claim 16, wherein the spring means includes a plurality of springs.

18. The latching assembly of claim 15, wherein the latching means includes a plate with a flange portion, the flange portion engaging the stop of the base member.

19. The latching assembly of claim 15, wherein the base member is a cabinet housing and the moveable member is a drawer of the cabinet.

20. The latching assembly of claim 15, wherein the moveable member includes a handle portion for grasping the moveable member and driving it from a closed to an open position and back to a closed position.

* * * * *

UNITED STATES PATENT AND TRADEMARK OFFICE

CERTIFICATE OF CORRECTION

PATENT NO. : 6,431,615 B1
DATED : August 13, 2002
INVENTOR(S) : John M. Bastian

It is certified that error appears in the above-identified patent and that said Letters Patent is hereby corrected as shown below:

Column 4,
Lines 1 - 4, after "member.", delete "engages the stop portion of the base member, a second linkage segment that connects the pivoting segment with the engaging segment and a second spring. --

Signed and Sealed this

Twenty-fourth Day of December, 2002

JAMES E. ROGAN
*Director of the United States Patent and Trademark Office*